US005899213A

United States Patent [19]

Kimata

[11] Patent Number: 5,899,213

[45] Date of Patent: May 4, 1999

[54] HAIR PROCESSING METHOD AND APPARATUS

[76] Inventor: Toshihiro Kimata, 15-6, Kotsubo 1-chome, Zushi, Kanagawaken, Japan

[21] Appl. No.: 08/643,778

[22] Filed: May 6, 1996

Related U.S. Application Data

[63] Continuation of application No. 08/223,993, Apr. 6, 1994, abandoned.

[30] Foreign Application Priority Data

Apr. 6, 1993 [JP] Japan ..... 5-079744

[51] Int. Cl.[6] ..... A45D 2/40

[52] U.S. Cl. ..... 132/225

[58] Field of Search ..... 132/210, 225, 132/224, 223, 211, 232

[56] References Cited

U.S. PATENT DOCUMENTS

| | | | |
|---|---|---|---|
| 943,321 | 12/1909 | Shero | 132/224 |
| 1,073,014 | 9/1913 | Andrews et al. | 132/225 |
| 1,465,838 | 8/1923 | Caneavri | 132/225 |
| 1,909,894 | 5/1933 | Protzky | 132/224 |
| 2,170,577 | 8/1939 | Shelby | 132/223 |
| 2,243,635 | 5/1941 | Karasiewicz | 132/225 |
| 2,377,877 | 6/1945 | Graham | 132/223 |
| 3,200,823 | 8/1965 | Sebastian | 132/223 |
| 4,740,669 | 4/1988 | Takimae | 132/232 |
| 5,357,988 | 10/1994 | Nakamura | 132/232 |

FOREIGN PATENT DOCUMENTS

| | | | |
|---|---|---|---|
| 86651 | 9/1920 | Switzerland | 132/224 |

*Primary Examiner*—Todd E. Manahan
*Attorney, Agent, or Firm*—Morrison Law Firm

[57] ABSTRACT

A hair processing apparatus has facing members for nipping hair. The facing members have uneven surface portions on their contact surfaces which are engaged with each other. The uneven surface portions have a plurality of grooves along their length directions. The hair is placed along the grooves between the facing members, and pressed by making the facing members closer. Simultaneously, the facing members are kept at a high temperature to heat the hair. A method for hair processing uses the apparatus.

2 Claims, 10 Drawing Sheets

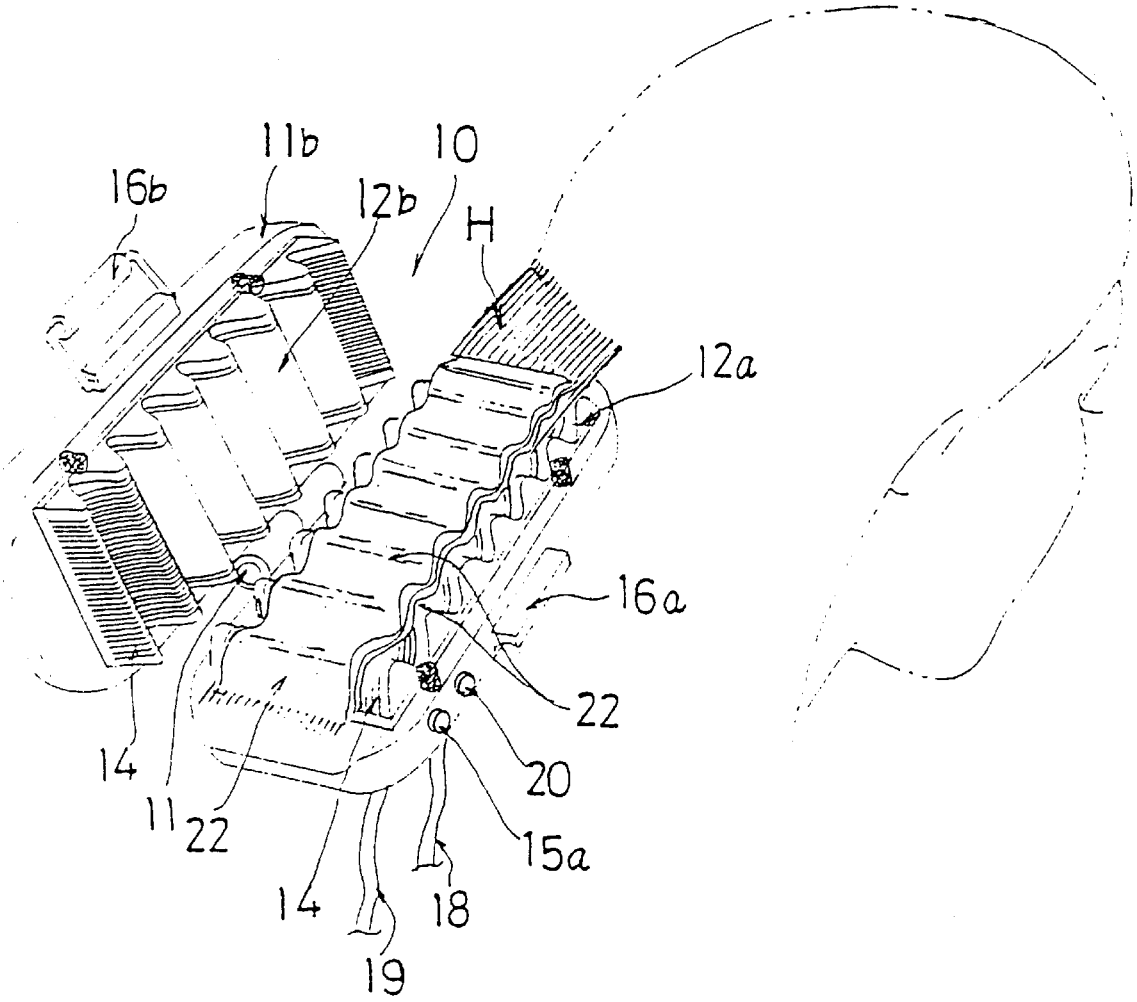
11b
10
16b
12b
H
12a
16a
22
20
15a
14
11
22
14
18
19

FIG. 8
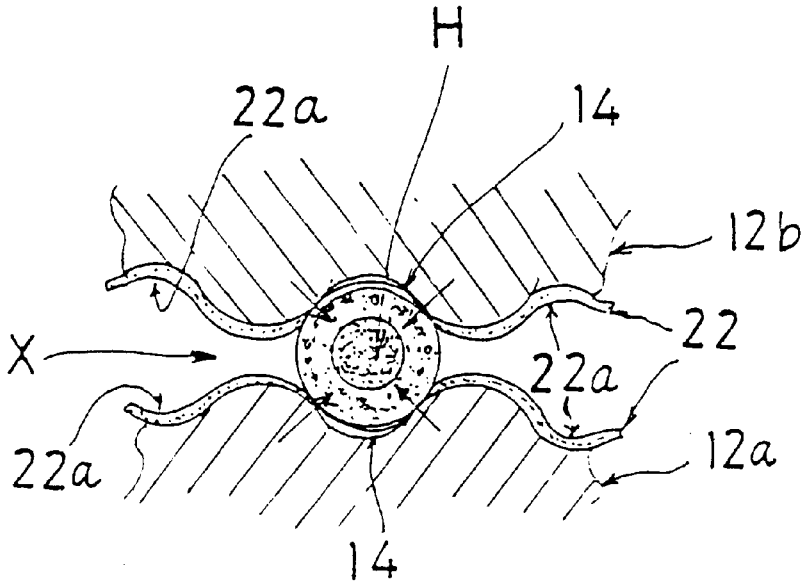
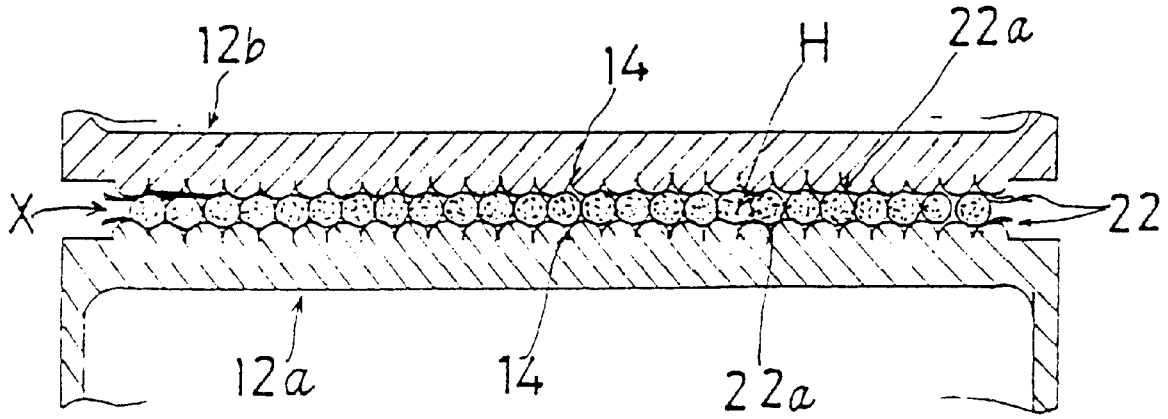
FIG.7

HAIR PROCESSING METHOD AND APPARATUS

This application is a continuation of application Ser. No. 08/223,993, filed Apr. 6, 1994, now abandoned.

BACKGROUND OF THE INVENTION

This invention relates to hair processing methods and apparatus to apply or transform permanent waves or related styles of hair, and more particularly to a method and apparatus which are based on the fact that essential characteristics of hair are changed by applying a predetermined pressure or certain pressure and heat to the hair, and which enables permanent wave shrunken or curled hair to be transformed into straight hair, to hair straightened by chemical process into waved hair, or make fine split hair back to the original state, and also enables to maintain processed states of straight, waved or treated hair for a long time.

Human hair, like skin and nails, consists of fibrous proteins known as keratins. Keratins are made up of coiled polypeptide chains combined to form supercoils of several polypeptides linked by disulfide bonds between adjacent amino acids. Aggregates of these supercoils form microfibrils, which are embedded in a protein matrix.

When analyzed on a individual structual basis, each hair is composed of a medullar (core) as its center, cortices which surround the medullar (the cortices are formed of longitudinally arranged spindle or cigar like shaped outer layer cells filled with keratin fibers), matrices which connects the cortex (outer layer) to each other (the matrices called padding material, have higher water absorption and moisture retention properties), and cuticles (outer layer of the hair) which surround the hair.

Therefore, to keep hair healthy for a long time, it is recommended to ingest adequate protein levels to provide enough to the body for forming keratin.

However, since hair is exposed to open air and sun light, and receives substances floating in the air, ingesting adequate protein as explained before does not suffice for ideal health of the hair. It is further recommended to make efforts to carry out hair health care by diligent shampoo and treatment of the hair.

For the purposes of this application, the term "permanent wave", which is a term of art, is defined as "Artificial waves in the hair produced by applying chemicals to it while wet, winding it on curlers, and drying it with heat." (The American Heritage Dictionary, Fourth College Edition, Houghton Mifflin Company, Boston—1991, at page 924). The noun form of this term may alternatively be utilized, and it is abbreviated herein as "perm". The term applies both to chemical treatments to impart and remove "waves" from the hair.

In a conventional processing of straight perm or wave perm, hair is washed and kept clean, and, a softening process (a first liquid process) is performed by applying or coating softening material such as a cold liquid onto the whole hair. Then, the whole hair is divided into some bundles, and, for each bundle, a heating process, combing process, deposition of creamy material, or rolling by a rod is performed (for wave perm). Next, a hardening process (a second liquid process) is performed by applying or coating hardening material such as a cold liquid. After a certain time period, if necessary, rods are removed, and the hair is processed with hot water rinse to finalize straight perm, wave perm or hair treatment.

The conventional straight perm, wave perm and hair treatment processes are performed by so called chemical steps only. That is, the stiffness of hair is changed by infiltrating the cold liquids (the first and second liquids) into matrices and cuticles portions of hair, and, during that process, the heating, combing, depositing or rolling process is performed for straight, wave perm or hair treatment. For that reason, the retention time of straight, wave perm and hair treatment is short.

According to conventional belief hair processing is time limited, and shape retention gradually degrades over time. Time for infiltrating cold liquids is limited in the above mentioned process (long time process involves significant damage to hair health condition), and it is impossible to infiltrate cold liquids into matrices and cuticles adequately. Further, frequent shampoo washes out the cold liquids and the hair tends to return to the original state. Thus the shape retention effect of straight or wave perm or hair treatment is gradually lost.

In order to improve the shape retention effect of the cold liquids, pH of the cold liquids (the first and second liquid) is, for example, adapted for each person according to her or his hair characteristics. However, adequate shape retention effects still have not been achieved according to known practice.

As a prior art means for heating hair, a heating iron having contact faces, which are formed in a shape such as a wave, was developed. In process of wave perm or the like with that iron, a bundle of hair is supported with one hand and the iron is held with the other hand. The bundle of hair is nipped between a pair of facing surface of the iron and the bundle of hair obtains the shape of the facing surface of the iron. The process is primarily based on the heating iron, and the object of the pressure applied to the hair while the hair nipped with the iron is to hold the hair. Therefore that process is completely different from hair processing of wave perm or the like, which will be clearly disclosed below. In other words, applications of pressure, based upon the structural characteristics of hair, have generally not be utilized in conventional hair processing techniques for to apply or transform permanent waves or related styles of hair.

OBJECTS AND SUMMARY OF THE INVENTION

The term "nipping" as employed in this application, is defined as known to those skilled in the art. The AMERICAN HERITAGE DICTIONARY OF THE ENGLISH LANGUAGE, at page 1224, includes the definition "seizing or pinching" which describes applicant's use of the term.

An object of the present invention is to provide a method and apparatus by which the structural characteristics of hair are modified based upon the property of hair is changed when a certain pressure, or a certain pressure and heat is applied to the hair, shrunk or curled hair can be easily permed into straight hair, or straight hair can be also permed into waved hair, and in which processed hair condition can be kept for a long time.

According to one aspect of the present invention, hair is divided into some bundles and each bundle of hair is pressed at a constant pressure with a pressing means having a shape of a wave or the like to process wave perm or the like.

According to another aspect of the invention, a softening process (a first liquid process) is performed by applying or infiltrating softening material to whole hair, the whole hair is divided into some bundle, each bundle of hair is pressed at a constant pressure with a pressing means having a shape of a wave or the like to process wave perm or the like, and after that a hardening process (a second liquid process) is performed by applying or infiltrating hardening material to the whole hair. Finally, hot water rinse is performed.

According to still another aspect of the invention, while hair is pressed at a constant pressure with the pressing means, the hair is under a heating process.

According to yet another aspect of the invention, a pressing means has facing members for nipping hair. The facing members have uneven surface portions on their contact surfaces which are engaged with each other. The uneven surface portions have a plurality of grooves along their length directions. The hair is placed along the grooves between the facing members, and pressed by making the facing members closer.

According to further another aspect of the invention, hair is covered with shape retention members and after that the hair is processed with a pressing means or a heating means to achieve beautiful shape of wave permed hair or the like.

By utilizing the above mentioned means and steps, the following operation is performed. When hair is pressed during a perming process, the pressed hair changes significantly. That is, microscopic observation of the intersection of a hair shows that the intersection shape of the hair is almost circular before pressure and that the shape changes into a compressed circular or elliptic one. The compressed circular or elliptic shape of the hair gets back to the original circular shape in a certain time period after removal of the pressure.

The inflation or restoration effect from the compressed circular or elliptic shape to the original circle is utilized for an effective perming process. That is, since a softening process (first liquid process) and hardening process (second liquid process) are performed while the hair inflates from the compressed state, infiltration of the first and second liquids into the hair is significantly improved and a wave perm process or the like is accordingly improved. That process is very effective for cases when shrunk or curled hair is permed into straight or when straight hair is permed into wave. Also hair treatment or the like can be easily carried out. Further, since the processing liquids in particularly the second liquid are retained very much, the good condition of straight perm, wave perm or hair treatment is kept even with frequent shampoo over a long time.

In the wave perm process or the like by using the pressing means, whole hair is divided into some bundles and each bundle of hair is orderly placed between the facing members along the grooves which are formed on the uneven surface portions of the facing members in their length directions. The uneven surface portions can be engaged with each other. The hair is then pressed by making the facing members closer and a wave perm process or the like is performed. The hair can be covered with shape retention members and after that the hair is placed under a constant pressure by making the facing members closer. The hair can be heated at the same time as it is pressed by heating the pressing means.

Accordingly, beautiful effects of wave perm process or the like, which can not be obtained by conventional wave perm process or the like, are achieved and the effect are retained for a long time.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 6 is a partial perspective view of an embodiment of the present invention in showing the hair processing apparatus in operation;

FIG. 7 is a side view of an embodiment of the present invention, illustrating the hair processing apparatus in a closed state, with hair pressed by the processing apparatus;

FIG. 8 is an enlarged intersection view showing the same;

DETAILED DESCRIPTION OF PREFERRED EMBODIMENTS

Figure 1:
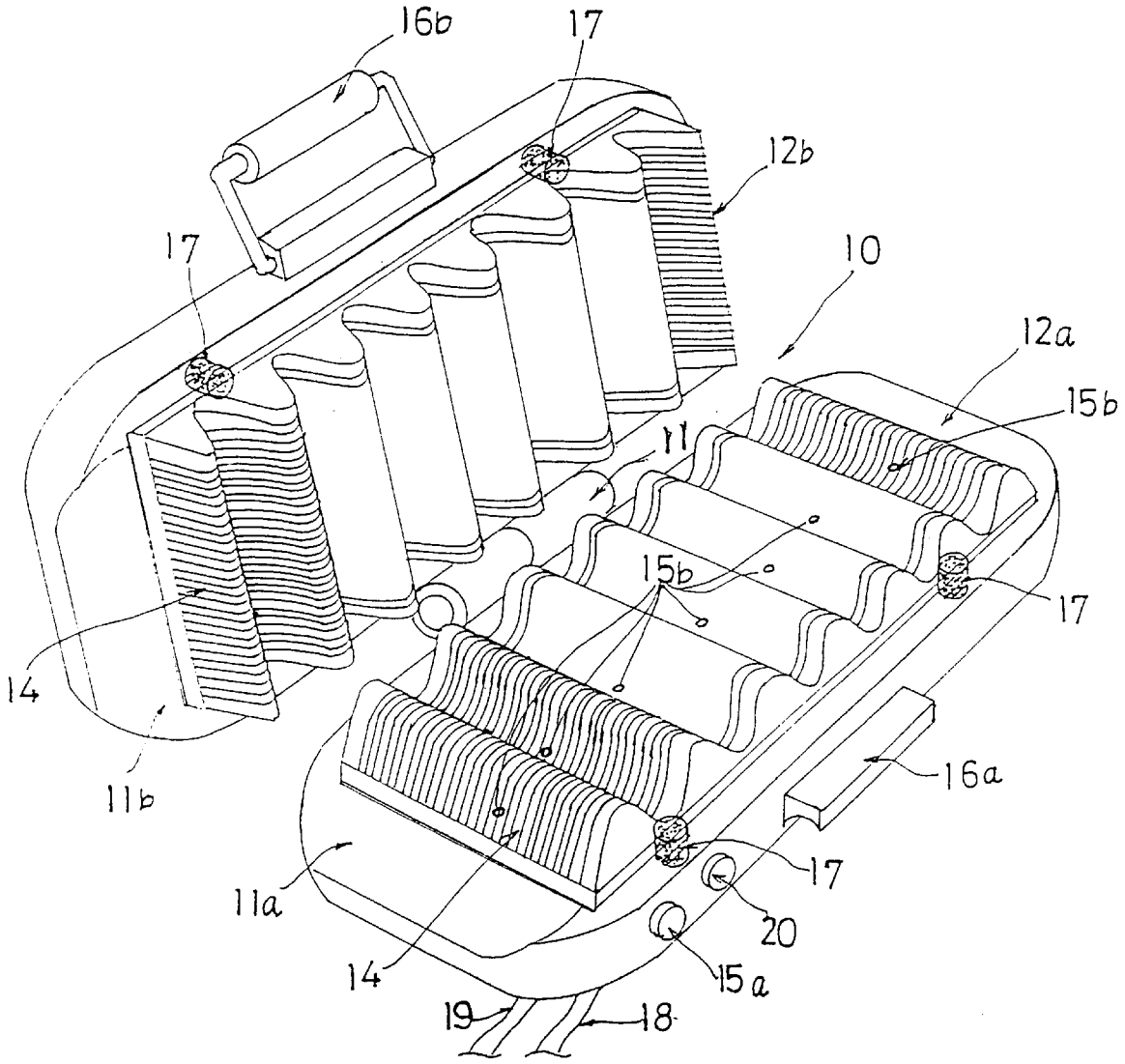
FIG. 1 is a pictorial diagram of an embodiment of the hair processing apparatus according to the present invention.

One embodiment of the method and apparatus of hair processing for wave perm or the like is described with reference to FIG. 1, FIG. 2, FIG. 3, FIG. 4, FIG. 5, FIG. 6, FIG. 7, FIG. 8, FIG. 9 and FIG. 10.

The method and apparatus of hair processing for wave perm or the like according to the present invention is based on the following discovery. In usual steps of hair processing for straight perm, wave perm and hair treatment, hair is washed out, the first liquid process is performed, and then the hair is shampooed to wash out the first liquid from the hair. During that shampoo, the back of the head is placed on a head rest, and hair portion hear the skin is bent and nipped between the back of the head and the head rest with a certain pressure. That is, the bent hair is pressed about ten Kg of the head weight for a short time during the shampoo, and after the head is lifted after the shampoo, the crease of the hair created by the pressure remains clearly. The inventor paid attention to a fact that the crease by the pressure can not be erased by the second liquid process, and made a research on its cause and during that research the present invention was made.

Usual Steps for Wave Perm or the Like

1) The characteristics of the hair of a client are checked by hair diagnosis. Whether or not the hair is easily permed in wave or the like, whether or not the hair has damages, and whether or not there is differences between the top of hair and the base of hair are determined.

2) Selection of the first liquid. A first liquid most appropriate to the hair of the client is selected based on the above diagnosis 1). A high Ph liquid is selected for hard or virgin hair. A low Ph liquid is selected for soft or dyed hair.

3) Preprocessing. The characteristics of a hair are different between its base and top. Then, in the preprocessing, care is taken to infiltrate the first liquid evenly for preventing damages. Further, when the hair is hard to be permed, the hair is such processed that it can be permed easily.

4) Selection of a rod size. The size of wave changes based on the thickness of rods. The rod size is selected based on the above diagnosis 1).

5) Hair is rolled around rods (for wave perm). The hair is sliced and a bundle of hair is grasped. That bundle of hair is then rolled around a rod such that uniform tension is applied at every point from the base to the top. For straight perm, the hair is sliced in the same manner and the grasped bundle of hair is put on a panel such that the bundle of hair is made straight from the top to the base.

6) The first liquid process (softening process. A cold liquid is usually used). After the process of 5), a first liquid is carefully deposited, and after that a cap is covered over the hair to prevent undesirable evaporation. It usually takes ten or fifteen minutes to infiltrate the first liquid into the hair.

7) After that, the first liquid is rinsed away with hot water and the effect of the first liquid is stopped.

8) The second liquid process (hardening process. A cold liquid is usually used). After the process of 6), a second liquid is applied much enough to the hair which was processed with the first liquid. Since the second liquid infiltrates more slowly than the first liquid, the application is repeated several times. The interval between one application to another should be long enough.

9) Postprocessing. The rods are removed, and the hair is rinsed with hot water, and the hair is finally set.

The above mentioned method for straight perm, wave perm and hair treatment is what is done at most beauty parlors.

Hair Processing for Wave Perm or the Like according to the Present Invention The first hair processing method of the present invention also uses the above mentioned steps 1), 2), 3), 4) and 5).

A) The first liquid process (softening process. A cold liquid is usually used). After the process of 5), a first liquid is carefully deposited, and after that a cap is covered over their hair to prevent undesirable evaporation. It usually takes ten or fifteen minutes to infiltrate the first liquid into the hair.

B) After that, the first liquid is rinsed away with hot water and the effect of the first liquid is stopped.

Figure 4:
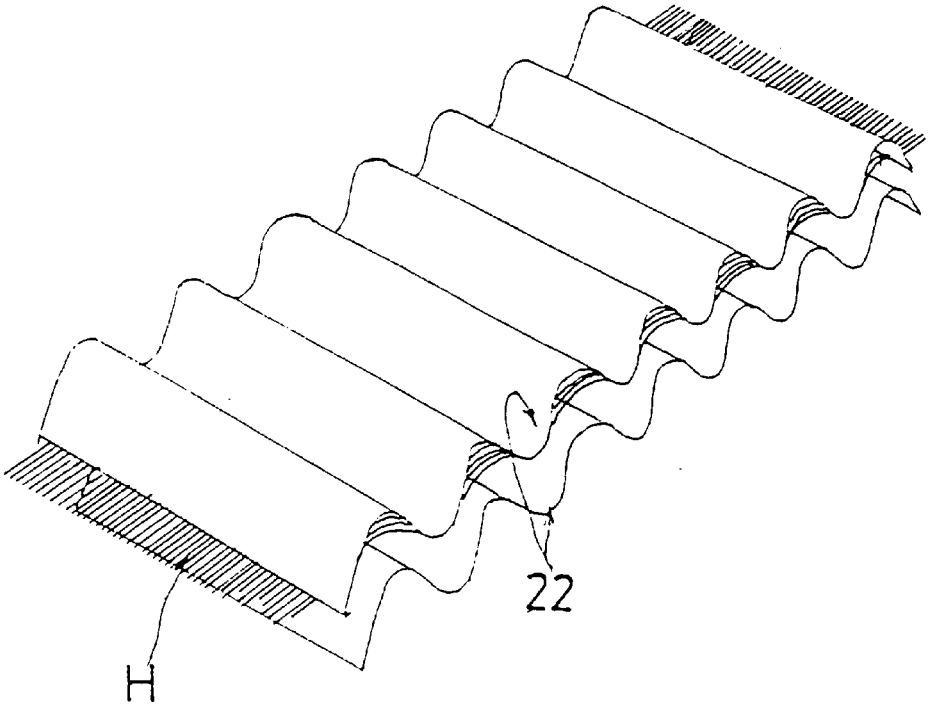
FIG. 4 is a pictorial diagram of shape retention members of an embodiment of the present invention, shown disposed about strands of hair.

C) After the step B), the whole hair is divided into some bundles as shown in FIG. 4, and each bundle of hair is nipped with a hair processing apparatus 10, which is described later in detail, to press the hair at a constant pressure or to press it at a constant pressure and heat it simultaneously.

"In examples, the hair was pressed at a pressure about ten Kg which is the weight of the head of a normal person. When heat was applied at the same time with the pressure, the pressure was about ten Kg and the temperature at facing surfaces of the hair processing apparatus 10 was from sixty to one hundred degree centigrade."

D) After the step C) hardening process (the second liquid process) is performed by applying or infiltrating hardening material to the whole hair. Since the second liquid infiltrates more slowly than the first liquid, the application is repeated several times. The interval between one application to another should be long enough.

When only hair treatment is required, the first liquid process is performed (a weaker cold liquid is used for the hair treatment than for straight perm or wave perm), and the first liquid is infiltrated among fine split pieces of cuticle (hair skin). The hair is then under a heating process and the cuticle has infiltrated first liquid therein and its naturalness is restored.

The second liquid process can be performed simultaneously with the heating or pressing step C). For that case, shape retention members which is described later in detail are used with the second liquid absorbed in the shape retention members.

E) Postprocessing. The hair is rinsed with hot water, and at last naturally dried, and then the process for wave perm or the like is completed.

DETAILED DESCRIPTION OF THE PREFERRED EMBODIMENT

Figure 2:
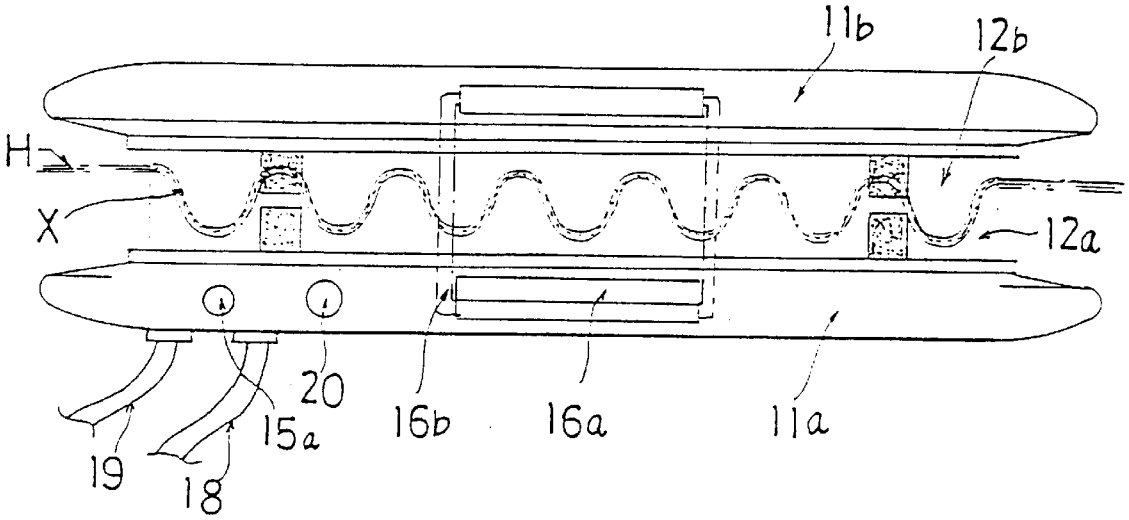
FIG. 2 is a side view of an embodiment of the hair processing apparatus according to the present invention.
Figure 3:
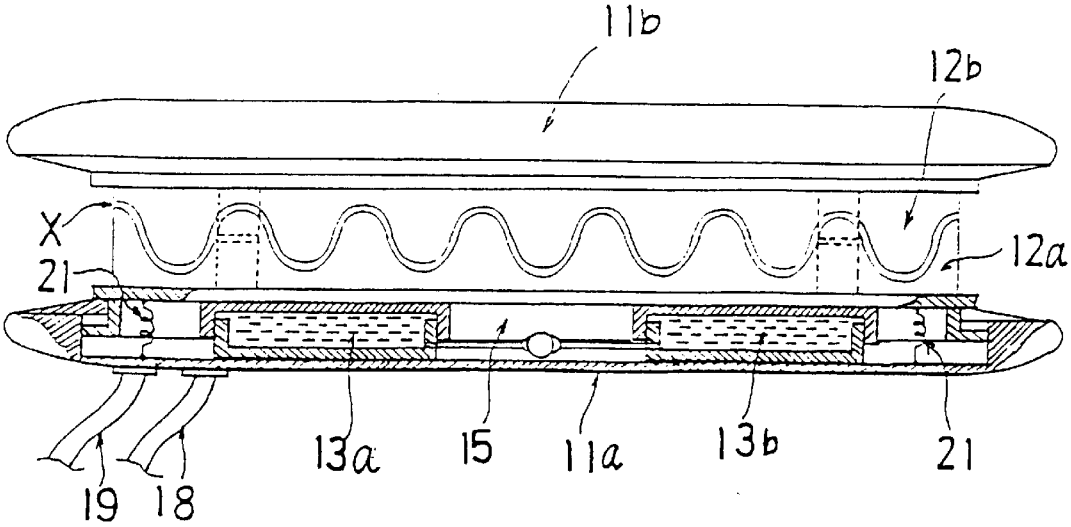
FIG. 3 is a side view of the hair processing apparatus according to the present invention, illustrating the apparatus wherein the first and second opposed surfaces are in a pressed position.

Now referring to FIG. 1 to FIG. 3, the hair processing apparatus 10 has a hinge 11 which enables the apparatus to open and close. First and second opposed facing members 11*a,* 11*b* are designed to nip hair H, and uneven surface portions 12*a,* 12*b* are formed on the contact faces of the facing members 11*a,* 11*b* respectively. The uneven surface portions 12*a,* 12*b* are engaged with each other when first and second opposed facing members 11*a,* 11*b* are closed. (In this embodiment, the uneven surface portions are formed in a wave shape, and they are referred to as wave shape portions from now on.) As shown in FIG. 3, one of the wave shape portions, particularly the wave shape portion 12*a* of the first facing member 11*a* for this embodiment can come up to the wave shape portion 12*b* which faces thereto by one of the reciprocating motions of two self-contained hydraulic cylinders (pressing means) 13*a,* 13*b.* The hydraulic cylinders 13*a,* 13*b* are designed to make the clearance X between the wave shape portions 12*a,* 12*b* at the closing positions closer.

The wave shape portions 12*a* and 12*b* have a plurality of grooves 14 regularly formed on their facing surfaces along their length directions. The hairs H are placed between wave shape portions 12*a* and 12*b* and pressed thereby. The hairs H are pressed by the V-shape surface portions of the plurality of grooves 14 formed on the wave shaped portions of the wave shape portion 12*a* on their upper side and are pressed by the V-shape surface portions of the plurality of grooves 14 formed on the wave shape portion 12*b* on their lower side (as shown in FIG. 7 and FIG. 8).

The wave shape portions 12*a,* 12*b* are designed to be kept at a certain temperature by means of a self-contained heating means 15 (steam is used as a heating source in this embodiment). The heating means 15 is designed to supply steam into the clearance X in response to the operation of a push button 15*a* on a first side of first opposed facing member 11*a.*

First and second opposed facing members 11*a,* 11*b* have a stopper 16*a* and a hook 16*b* on the opposite sides to those on which hinge 11 is mounted. On those opposite sides, the wave shape portions 12*a,* 12*b* of first and second opposed facing members 11*a,* 11*b* have right and left pairs of magnets 17 at their edges. The left pair of magnets 17 are faced towards one another with the same poles facing to one another. Also the right pair of magnets 17 are faced in a similar manner. The magnets 17 work as a buffering member when the facing members 11*a,* 11*b* is closed.

The pressure oil for the two hydraulic cylinders 13*a,* 13*b* and the steam for the heating means 15 are supplied by means of flexible hoses 18, 19 from external sources (not shown). The pressure of the hydraulic cylinders 13*a,* 13*b* is controlled by a knob 20 on a side of the facing member 11*a.*

In the figures, members 21 are springs for pulling back the wave shape portion 12*a* of first facing member 11*a* to the original position from a position to which the hydraulic cylinders 13*a,* 13*b* pushed it.

First and second members 22 shape retention members which are placed on the upper and lower sides of the hair H when the hair H is nipped with first and second opposed facing members 11*a,* 11*b.* First and second opposed shape retention members 22 keep the hair H in a shape like first and second surfaces of the wave shape portions 12*a,* 12*b.* The shape retention members 22 are formed of high water (liquid) absorption material, and also formed of light metal for example aluminum or resinous material which is hard enough to keep the formed shape (which are the same as those formed on the wave shape portions 12*a,* 12*b* on the contact surfaces of the facing member 11*a,* 11*b*). The shape retention members 22 has, at least on surface which the hair makes contact with, a plurality of grooves 22*a* along their length directions as first and second opposed facing members 11*a,* 11*b* have. The hair H is ordinarily placed along the grooves 22*a* during the process of wave perm or the like.

Although the hair processing apparatus of a hand held type is disclosed for the embodiment, a stand type can be used for example when a plurality of hair processing apparatus 10 are used. The present invention is likewise capable of being applied to other variations.

Next is described how imparting or applying a wave perm with the above mentioned hair processing apparatus 10.

Figure 5:
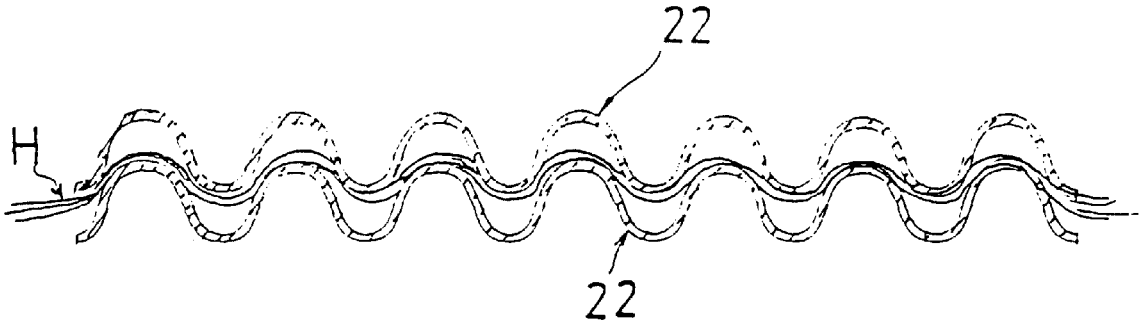
FIG. 5 is a side view of an embodiment of the present invention showing shape retention members with hair nipped with them.

The first liquid (softening material. A cold liquid is usually used.) is carefully applied to the hair, and after that, time for infiltration is needed. After a predetermined interval of time has passed, hot water rinse is performed to wash the first liquid away and stop the effect of the first liquid. The hair H is then divided into a plurality of bundles (as shown in FIG. 6), and each bundle is placed between the shape retention members 22 (as shown in FIG. 4 and FIG. 5) which make contact with the top and bottom sides of the hair H. The bundle of hair is nipped with the hair processing apparatus 10 together with the shape retention members 22, and is processed under predetermined levels of pressure or under predetermined levels of pressure and a high temperature.

The pressing process is performed by operating the knob 20 of hydraulic cylinders 13*a,* 13*b* to make first facing facing member 11*a* close to second facing member 11*b.* The resultant pressure compresses the hair H and shape retention members 22.

Simultaneously heating can be performed by supplying steam to the heating means 15. For that purpose the button 15*a* on the side of first facing member 11*a* is operated to inject steam into the clearance X through holes 15*b* formed at appropriate positions of the wave shape portions 12*a,* 12*b.* Certain heat is thus provided to the hair H nipped with the hair processing apparatus 10.

Processing time is contingent upon individual hair treatment needs which vary from person to person, and is from ten to fifteen minutes.

After that process, the hair processing apparatus 10 is removed and then a hardening process (a second liquid process) is performed by applying or infiltrating a hardening material to the whole hair. Since the second liquid infiltrates more slowly than the first liquid, the application is repeated several times. The interval between one application to another should be long or short depending on the degree of infiltration derived from.

The second liquid process can be done simultaneously with the pressing or heating process. In that case, the process is performed with the shape retention members 22 having the second liquid infiltrated therein by way of a sufficient aliquot. While the process for one bundle of the hair H is completed as described above, the same process is repeated for each bundle of the hair H (as shown in FIG. 9).

Figure 9:
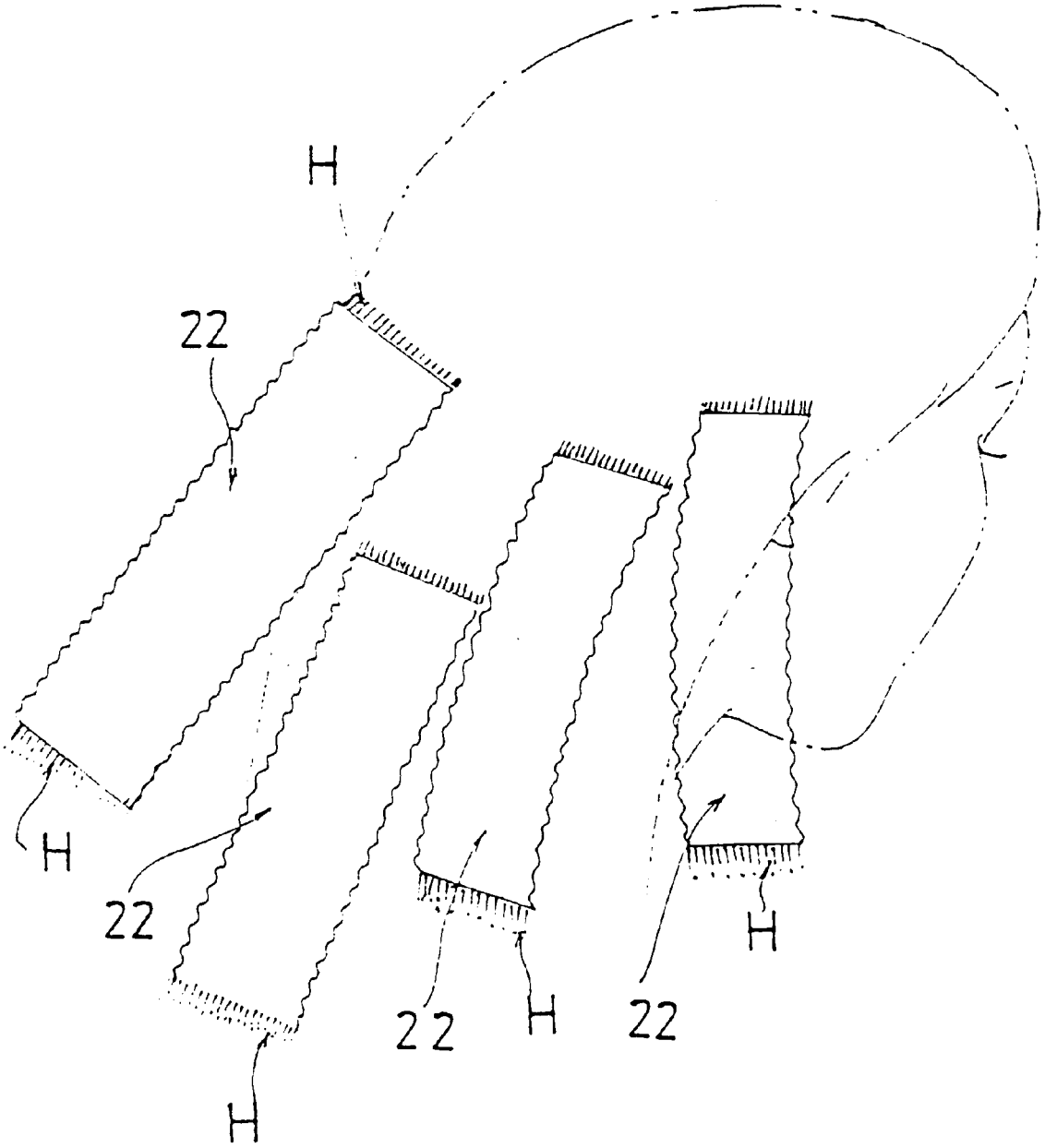
FIG. 9 is a diagram explaining how hair is divided in a hair processing method of the invention.

Even after the hair processing apparatus 10 is removed from the pressed and heated hair H, the shape retention members 22 (as shown in FIG. 9) still cover the hair H and the hair H is so kept in a wave shape until the shape retention members are removed. After that, hot water rinse is performed and final natural drying is performed to complete the process.

Figure 10:
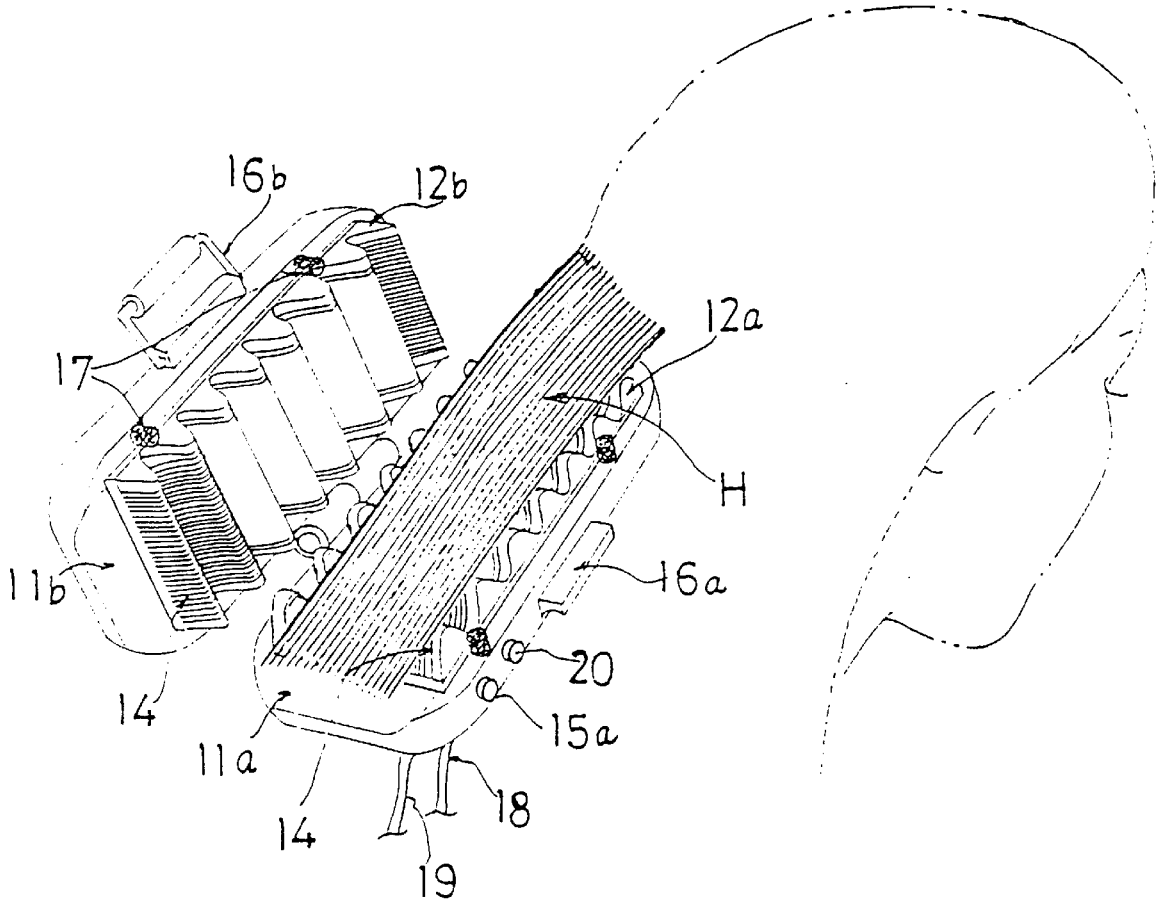
FIG. 10 is a diagram explaining another example of the hair processing method of the invention.

Although the above embodiment was described with the case where, for wave perm processing, the first liquid was washed away to stop its effect, the hair H was divided into bundles, the shape retention members were placed on the upper and lower side of each bundle of the hair H to hold it, the bundle of the hair H together with the shape retention members 22 was nipped by the hair processing apparatus 10 under predetermined pressure and heating state, the present invention can be applied to, for example as shown in FIG. 10, a case where the first liquid is washed away to stop its effect, the hair H is divided into bundles, and each bundle of the hair H is directly nipped by the hair processing apparatus 10 under a predetermined pressure conditions to apply or remove wave or straight perms. The present invention is not limited to the above embodiment.

According to an alternate preferred embodiment of the present invention, a pair of rollers are pressingly engaged by way of springs and an electric motor to process hair.

Figure 11:
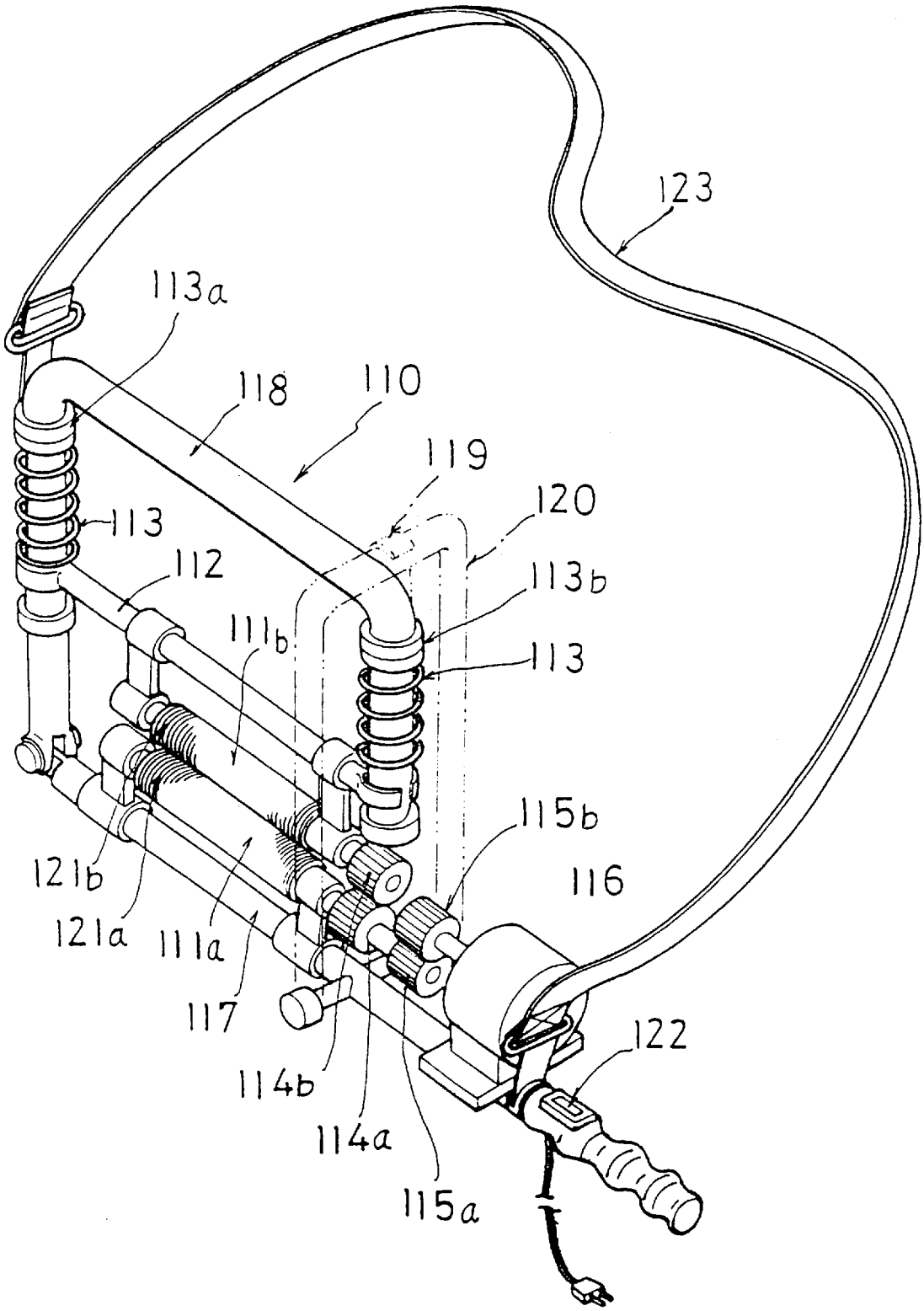
FIG. 11 is a pictorial diagram of alternative hair processing apparatus performing the present invention.
Figure 12:
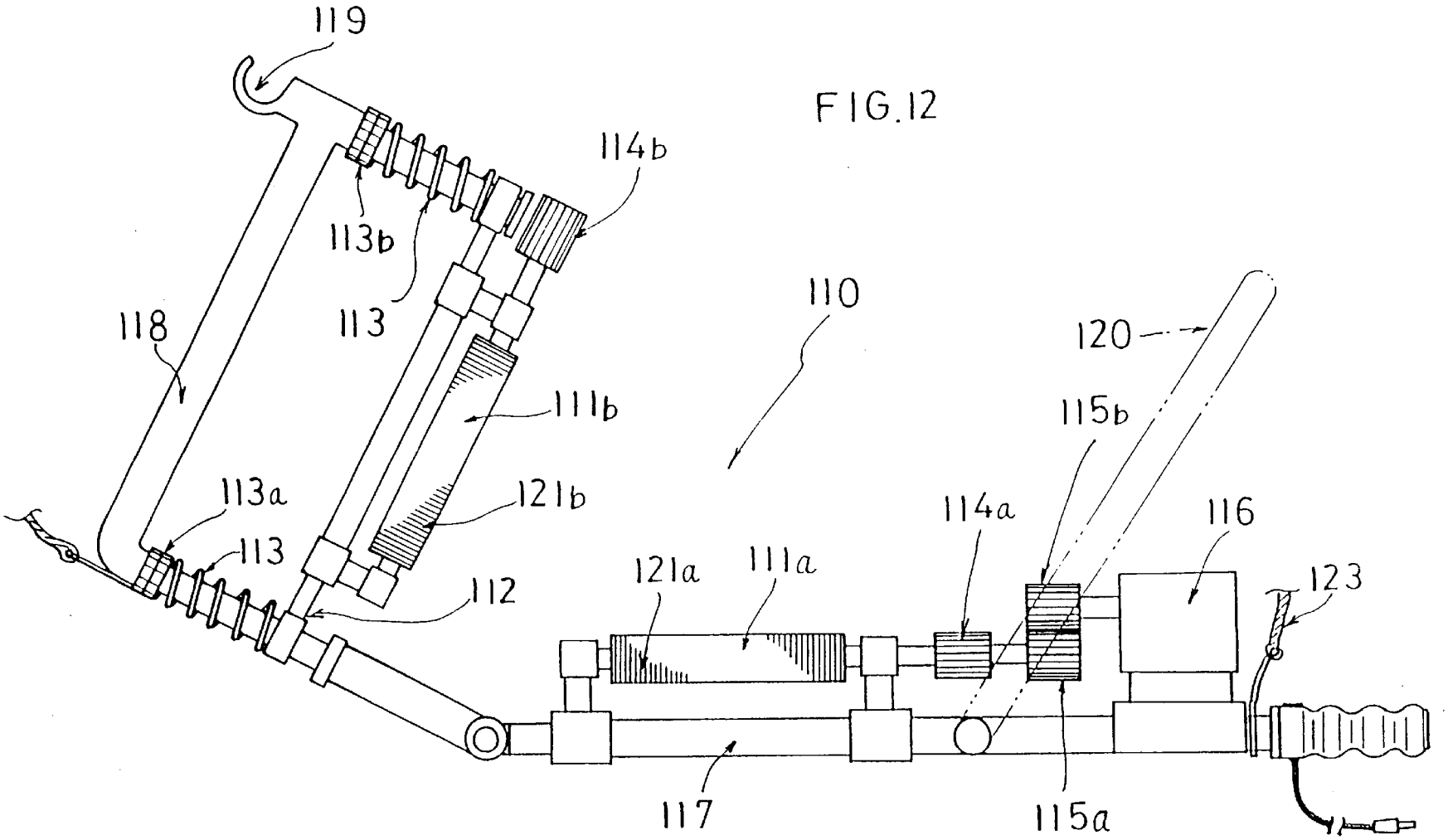
FIG. 12 is a diagram showing the alternative hair processing apparatus at the rest position.
Figure 13:
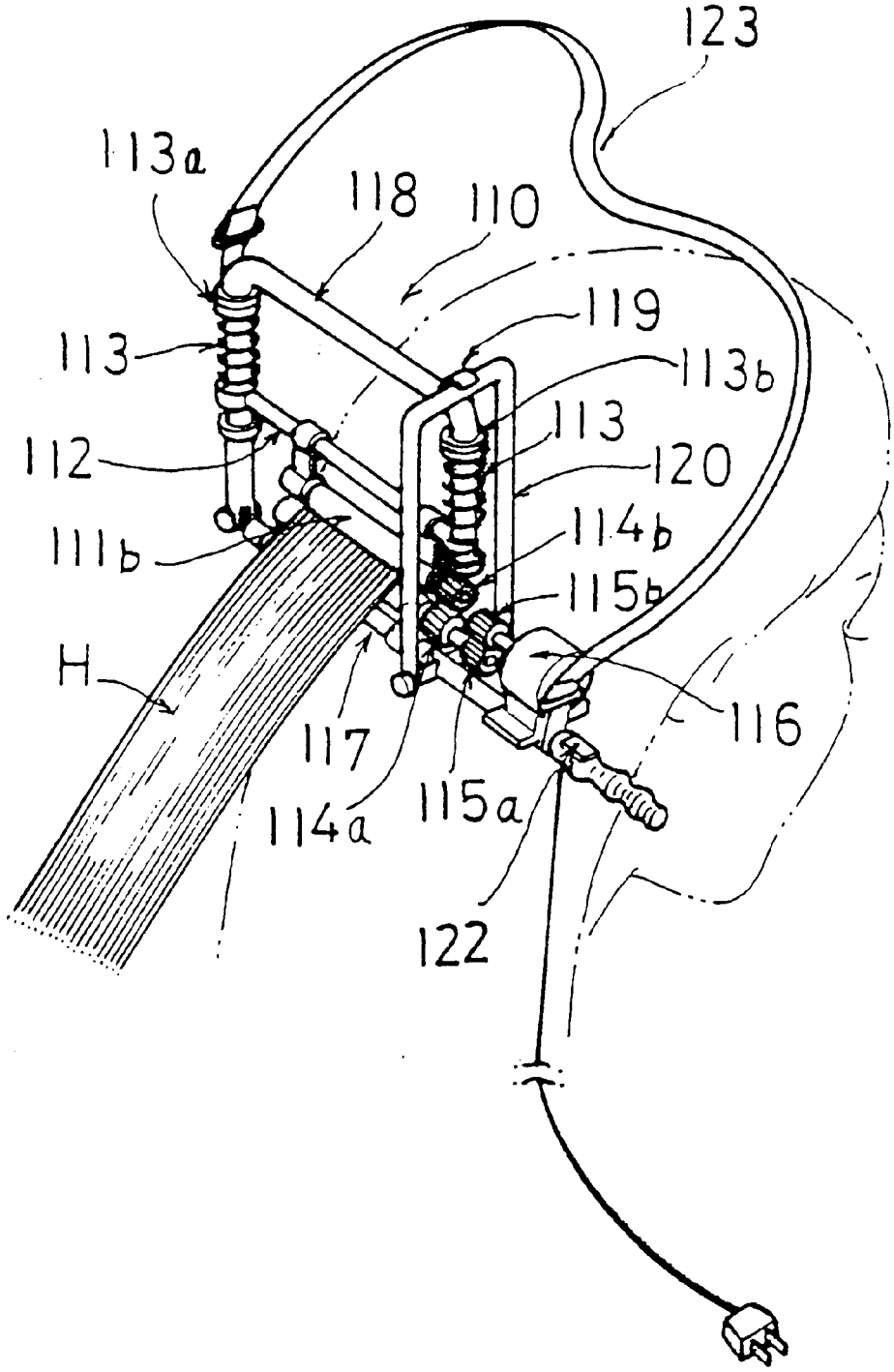
FIG. 13 is a diagram explaining the pressing step by the alternative hair processing apparatus.

Referring to FIG. 11, FIG. 12 and FIG. 13, a hair processing apparatus 110 according to this embodiment has a pair of rollers 111*a,* 111*b,* the roller surfaces of which are designed to make contact with each other when the upper roller 111*b* is set at a operation position (as shown in FIG. 11). The upper roller 111*b* is then pushed downward by a spring member 113 so that the roller surface of the upper roller 111*b* presses the roller surface of the lower roller 111*a.* The rollers 111*a,* 111*b* designed to be driven by an electric motor 116 by means of gears 114*a,* 114*b,* 115*a,* 115*b.*

The upper roller 111*b* is mounted on a lateral bar 112 which is then mounted to a movable frame 118 which can move between the operation position (FIG. 11) and a release position (FIG. 12). The lower roller 111*a* is mounted on another lateral bar 117, and a movable stopper 120 is also mounted on the lateral bar 117. The movable frame 118 at the operation position is locked by the stopper 120, the top of which is engaged with the hoop 19 of the frame 118.

The rollers 111*a,* 111*b* have grooves parallel to their length directions around them so that hair is regularly proceeded.

When used, the hair processing apparatus is held with shoulder belt 123 and a grip which has a on-off button 122 for an electric motor 116 on it. A user can support the apparatus 110 with one hand because of the shoulder belt 123, and then the user can treat the hair with the other hand.

In operation, the upper roller 111*b* is set at the rest position (FIG. 12), and hair H is placed on the lower rollers 111*a.* The upper roller 111*b* is then moved to the operational position (FIG. 11) and the stopper 120 is set to lock the frame 118. The hair H is nipped between the upper roller 111*b* and the lower roller 111*a,* under a force of approximately 10 kg, and then moved forward. The electric motor 16 is of a reciprocation type and the hair can be moved forward and then backward.

Although, in the above embodiment, the transmission ratios for the pair of roller 111*a,* 111*b* are fixed and utilize a constant rate for straight perm, the transmission ratios for them can be varying and different from each other slightly for wave perm.

As described in the above, according to the present invention, in particular, one aspect of the present invention, hair is divided into some bundles and each bundle of the hair is pressed at a constant pressure with a pressing means having a shape of a wave or related shapes in order to process wave perm straight perm, and related styles of hair.

According to another aspect of the invention, a softening process (first liquid process) is performed by applying or infiltrating softening material to whole hair, the whole hair is divided into some bundle, each bundle of hair is pressed at a constant pressure with a pressing means having a shape of wave or the like to process wave perm or the like, and after that a hardening process (second liquid process) is performed by applying or infiltrating hardening material to the whole hair. Finally, hot water rinse is performed.

According to further another aspect of the invention, while hair is pressed at a constant pressure with the pressing means, the hair is under heating process.

According to further another aspect of the invention, the pressing means has facing members for nipping hair. The facing members have uneven surface portions on their contact surfaces which are engaged with each other. The uneven surface portions have a plurality of grooves along their length directions. Hair is placed along the grooves between the facing members, and pressed by making the facing members closer.

According to further another aspect of the invention, a pressing means has the facing members for nipping the hair. The facing members have the uneven surface portions on their contact surfaces which are engaged with each other. The uneven surface portions have the plurality of grooves along their length direction. The hair is placed along the grooves between the facing members with shape retention members covering the hair, which is pressed at a certain pressure by making the facing members closer.

According to further another aspect of the invention, the shape retention members, which cover the hair on its upper and lower sides, are formed in the almost same shape as the uneven surface portions on the contact surfaces of the pressing means. The shape retention members also have a plurality of grooves along their length directions such that the hair can be ordinarily placed along the grooves.

According to yet another aspect of the invention, a pressing means has, beside with facing members for nipping hair, a heating means for keeping the facing members at a constant hot temperature. By making the facing members closer, the hair is pressed and heated at a certain pressure and temperature.

Accordingly, the infiltration of the first and second liquids into the hair is significantly improved and a wave perm process or the like is accordingly improved. That process is very effective for cases when shrunk or curled hair is permed into straight or when straight hair is permed into wave. Also hair treatment or the like can be easily carried out. Further, since the processing liquids in particularly the second liquid are retained very much, the good condition of straight perm, wave perm or hair treatment is kept even with frequent shampoo over a long time.

In the wave perm process or the like by using the pressing means, the hair is covered with shape retention members and after that the hair is placed under a constant pressure by making the facing members closer. The hair is heated at the same time as it is pressed by heating the pressing means.

Accordingly, beautiful effects of wave perm process or the like, which can not be obtained by conventional wave perm process or the like, are achieved and the effect are retained for a long time. The present invention can achieve other significant advantages as well as the above.

The invention has been explained with reference to specific embodiments. Other embodiments will be apparent to those of ordinary skill in the art. It is therefore not intended that this invention be limited, except as indicated by the appended claims.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A hair processing apparatus comprising:

first and second opposed wave shaped members;

said first and second opposed members having a corresponding plurality of grooves on opposed facing surfaces thereon;

said plurality of grooves being arranged, one parallel with another, transverse to a wave array of each of said first and second opposed members;

each of said plurality of grooves having a depth and a width sized effective for receiving one hair;

means for applying a variable amount of pressure;

means for pressing; and said means for pressing having spring members activated by gears.

2. A hair processing apparatus for accepting and shaping a plurality of hair strands, comprising:

first and second members movable to a closed position where, in said closed position, a face surface of each of said first and second members opposes a face surface of another of said first and second members;

said first and second members having respectively a first plurality of grooves and a second plurality of grooves on said face surfaces of said first and second members;

each groove of said first plurality of grooves being arranged parallel one with another and longitudinally disposed in a first common direction;

each groove of said second plurality of grooves being arranged parallel one with another and longitudinally disposed in said first common direction;

said each groove of said first plurality of grooves has a first depth and a first width sized effective to receive one hair;

said each groove of said second plurality of grooves has a second depth and a second width sized effective to receive one hair;

said first depth being in a substantial opposing alignment with said second depth of a corresponding opposing groove, of said second plurality of grooves, when said first and second members are in said closed position;

at least one of said first and second members including means for applying heat;

means for moving said first and second members between said closed position and an open position thereof;

means for pressing said first and second members together for nipping said hair;

said means for pressing including means for applying a variable amount of pressing pressure effective to reform said hair;

said first and second opposed members having uneven surface portions formed in a shape of a wave, wherein said shape is formed in a second direction transverse to said first common direction;

said uneven surface portions are removable;

said first opposed surface member being moveable toward said second opposed surface member for engagingly contacting said second opposed surface member wherein hair is held between each of said opposing facing surfaces along said grooves, and at least one of heat and pressure is applied; and said means for pressing includes at least one hydraulic cylinder.

* * * * *